US007481317B2

(12) United States Patent
Brim, III

(10) Patent No.: US 7,481,317 B2
(45) Date of Patent: Jan. 27, 2009

(54) BRIEFCASE FOR CARRYING AND USING A PROJECTOR AND COMPUTER

(76) Inventor: James Croswell Brim, III, 3263 Mitsy Forest Way, Marietta, GA (US) 30068

( * ) Notice: Subject to any disclaimer, the term of this patent is extended or adjusted under 35 U.S.C. 154(b) by 311 days.

(21) Appl. No.: 11/381,063

(22) Filed: May 1, 2006

(65) Prior Publication Data

US 2007/0251846 A1 Nov. 1, 2007

(51) Int. Cl.
*A45C 3/02* (2006.01)

(52) U.S. Cl. ..... 206/576; 206/701; 190/902; 190/112

(58) Field of Classification Search ..... 206/576, 206/320, 701, 722; 190/900, 902, 1, 109, 190/112, 119; 361/681, 683
See application file for complete search history.

(56) References Cited

U.S. PATENT DOCUMENTS

| | | | | |
|---|---|---|---|---|
| 2,560,335 | A * | 7/1951 | Ericson | 359/443 |
| 4,837,590 | A * | 6/1989 | Sprague | 346/145 |
| 5,379,893 | A | 1/1995 | Ruiz | |
| 5,857,568 | A | 1/1999 | Speirs | |
| 5,967,270 | A | 10/1999 | Shyr | |
| 6,126,012 | A * | 10/2000 | Roegner | 206/579 |
| 6,442,018 | B1 | 8/2002 | Dinkin | |
| 6,504,706 | B2 * | 1/2003 | Stewart | 361/681 |
| 6,722,673 | B1 | 4/2004 | Hamlin | |
| D499,883 | S | 12/2004 | Perella et al. | |
| 6,871,739 | B2 | 3/2005 | Lopez | |
| D504,229 | S | 4/2005 | Duvigneau | |
| 6,935,498 | B1 | 8/2005 | Ho | |
| 7,035,093 | B2 * | 4/2006 | Imsand | 361/683 |
| 2002/0027767 | A1 * | 3/2002 | Ryder | 361/683 |
| 2002/0030966 | A1 * | 3/2002 | Huggins | 361/683 |
| 2004/0232019 | A1 * | 11/2004 | Salvatori | 206/320 |
| 2005/0045505 | A1 | 3/2005 | Vandevenne et al. | |

OTHER PUBLICATIONS

SmartMoney magazine; 2004; advertisement; MobileComputing APC.

* cited by examiner

*Primary Examiner*—Jacob K Ackun, Jr.
(74) *Attorney, Agent, or Firm*—Smith, Gambrell & Russell LLP

(57) ABSTRACT

A briefcase that is used to jointly support a projector and a computer and to allow quick and easy connection between the projector and the computer prior to the presentation, only one power connection from the briefcase to the electrical outlet upon arrival and without requiring that either of the components be removed from the briefcase for desired operation. The briefcase includes a first section to receive the computer and a second section to receive the projector, with the first section and the second section sharing a center partition. A first securing or closure member is connected to the central partition, and a first connecting element is attached proximate one end of the closure member, with a corresponding first connecting element being affixed proximate one edge of the first outer surface to secure the computer in the first section. A second securing or closure member is also connected to the central partition, with a second connecting element attached proximate one end of the closure member, with a corresponding first connecting element being affixed proximate one edge of the second outer surface to secure the projector in the second section.

11 Claims, 5 Drawing Sheets

40a
2
22
2
24
34
28
30
38

40a
22
34
36b
36a
20
10
30
29
14
12

BRIEFCASE FOR CARRYING AND USING A PROJECTOR AND COMPUTER

FIELD OF THE INVENTION

The present invention relates to a briefcase or attaché case for conjunctively carrying and using a projector and computer. More specifically, the invention is directed to a briefcase for carrying and using a projector and computer that allows the user to easily arrange for the use of the projector.

BACKGROUND OF THE INVENTION

The use of a computer and projector to provide a presentation is well known in the art. That is, for many oral presentations, the user will wish to use presentation software to outline or augment the presentation. Such presentation software generally incorporates text, graphics, movies, and other visual and audio materials that are positioned or associated on individual pages or "slides." These pages may be displayed on-screen through the use of projector connected with the computer. Thus, the presentation may be electronically stored on the computer and then broadcast using the projector.

As a result, for the speaker to use the presentation software in a presentation, the user is required to have both a computer and a projector available. Practically speaking, the user must take both devices to the location of the presentation, or hope that one or both devices will be present at the location. In transporting the computer and the projector to the location, the user has conventionally had a variety of briefcases and other forms of luggage that are designed to carry one of the items. For example, multiple briefcase or attaché case designs are known that are adapted to carry or contain small personal computers, commonly referred to as "notebooks." In some designs, the computer is loosely supported, while in others, the computer is connected or even semi-permanently attached. In the most common briefcases, the case includes a outer casing with a single opening, and an inner divider separating the casing into two compartments for independently storing the computer with any papers or other materials. Other briefcases are of a "clamshell" design, such that the computer is held in one side with a restraining member or strap, while the opposing side is free for the user to store other documents or materials.

While there are various cases known in the art for supporting a computer and/or a projector by the user, none of these designs provide the advantage of supporting both the computer and the projector or other electronic equipment in one single briefcase, wherein the computer and the projector may be connected in the briefcase to ease use of the projector at the location of the presentation.

BRIEF SUMMARY OF THE INVENTION

The present invention is a briefcase that is used to jointly support a projector and a computer. The briefcase provides a means to allow quick and easy connection between the projector and the computer prior to the presentation, requiring only one power connection from the briefcase to the electrical outlet upon arrival, and without requiring that both of the components be removed from the briefcase for desired operation.

The briefcase includes a first section to receive the computer and a second section to receive the projector, with the first section and the second section sharing a center partition. A first securing or closure member is connected to the central partition, and a first connecting element is attached proximate one end of the closure member, with a corresponding first connecting element being affixed proximate one edge of the first outer surface to secure the computer in the first section. A second securing or closure member is also connected to the central partition, with a second connecting element attached proximate one end of the closure member, with a corresponding first connecting element being affixed proximate one edge of the second outer surface to secure the projector in the second section.

BRIEF DESCRIPTION OF THE DRAWINGS

An briefcase for carrying and using a projector and computer embodying the features of the present invention is depicted in the accompanying drawings, which form a portion of this disclosure, wherein.

DETAILED DESCRIPTION OF THE INVENTION

Figure 1:
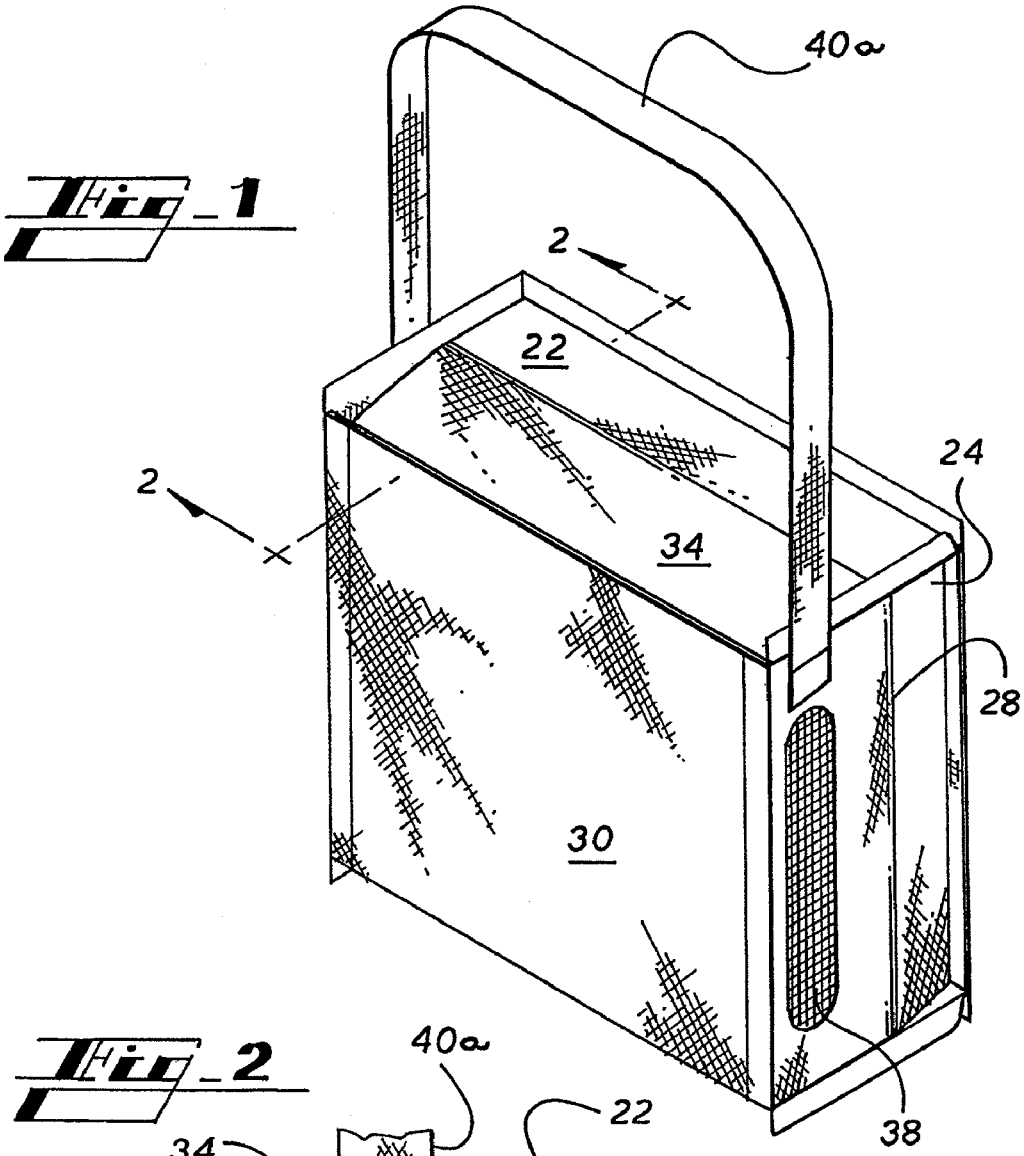
FIG. 1 is a perspective view of the briefcase of the present invention.

Looking to FIGS. 1-8, the present invention of a case 10 (such as a briefcase or attaché case) is illustrated. The briefcase 10 is used to jointly enclose and support a projector 6 and a computer 8 concurrently and providing a means to allow quick and easy connection between the projector 6 and the computer 8 without requiring that one component be removed from the briefcase 10. More specifically, the briefcase 10 includes a first top section 12 to receive the computer 8 and a second bottom section 14 to receive the projector 6, with the first section 12 and the second section 14 being separated by a center or intermediate partition 28 affixed within the briefcase 10.

Figure 3:
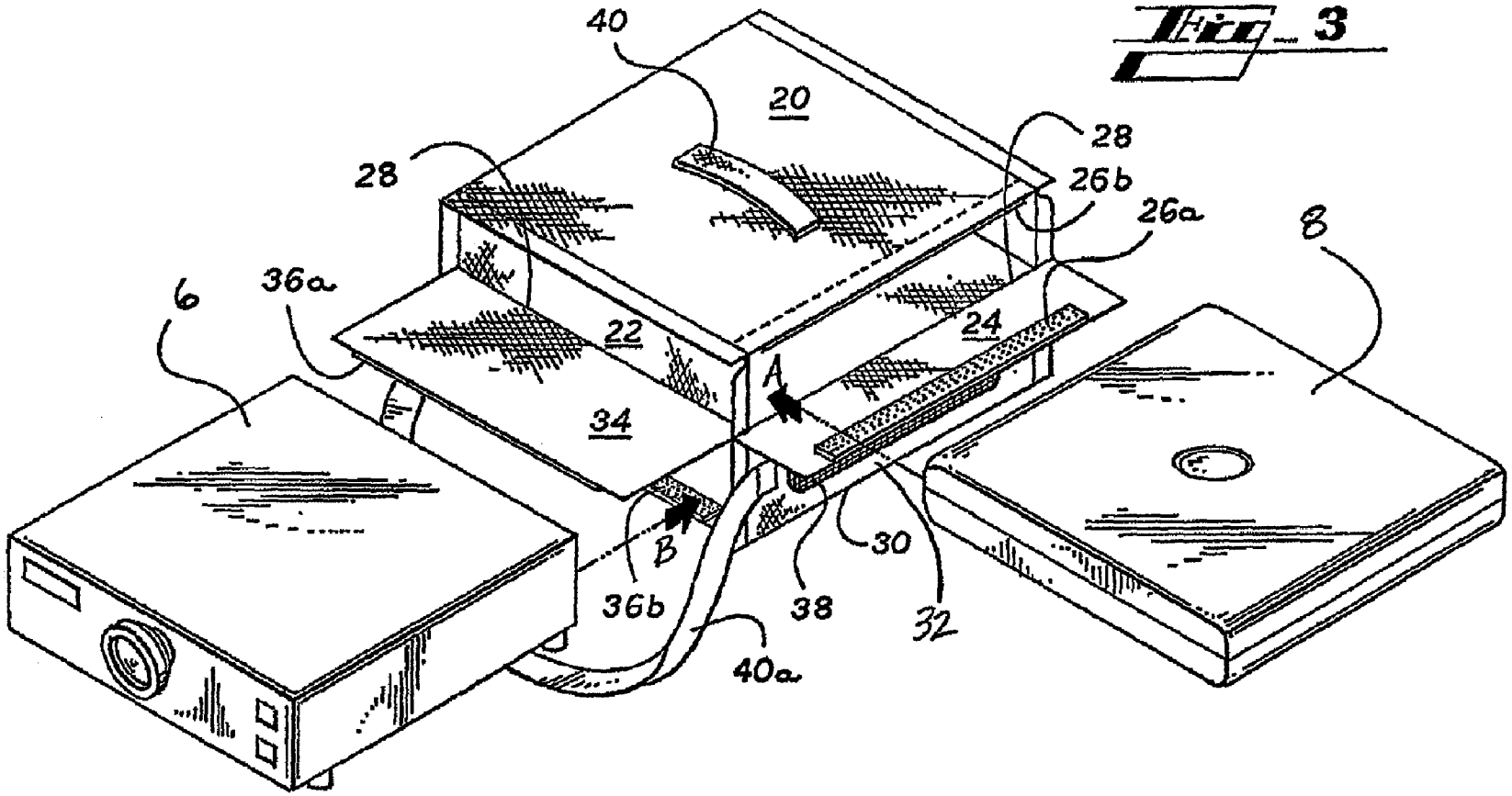
FIG. 3 briefcase is a perspective view of the briefcase of the present invention receiving a projector and a computer.
Figure 4:
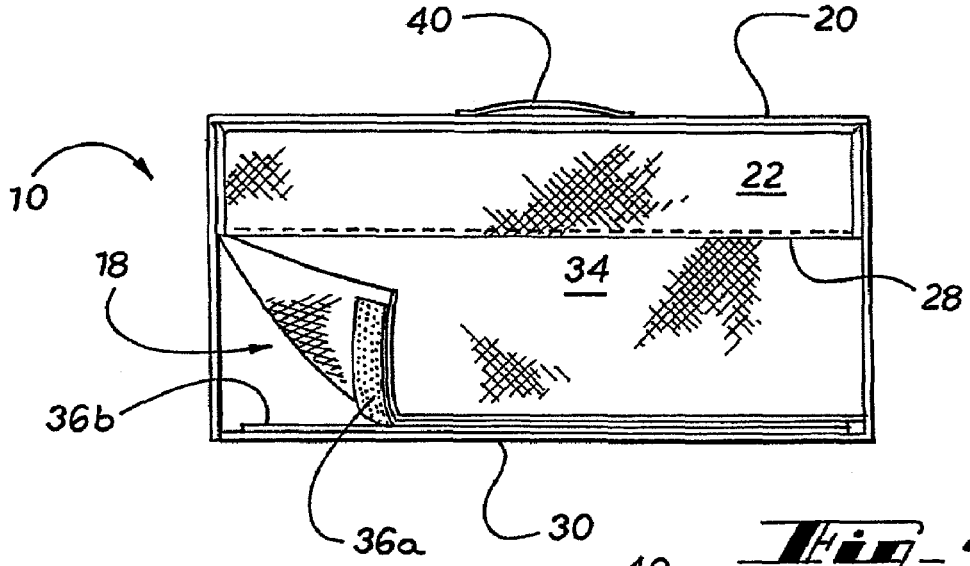
FIG. 4 is a front elevational view of the briefcase of the present invention illustrated in FIG. 1.

Referring to FIG. 3, the first section 12 is defined by a first outer surface or top wall 20 and side surfaces 22 that are positioned between the first outer surface 20 and the center partition 28, with these elements defining a first opening 16 to receive the computer 8. A first securing or closure member 24 is connected to the central wall 28. In the embodiment illustrated in FIGS. 3 and 6, a first connecting element 26*a*, such as a hook and loop material, button, zipper, or other similar fastener, is attached proximate one end of the closure member 24, with a corresponding first connecting element 26*b* being affixed proximate one edge of the first outer surface 20. As a result, once the user has inserted the computer 8 into the first section 12 (in direction A), the first connecting element 26*a* attached to the closure member 24 can be connected with the second connecting member 26*b* to secure the computer 8 within the first section 12.

Figure 5:
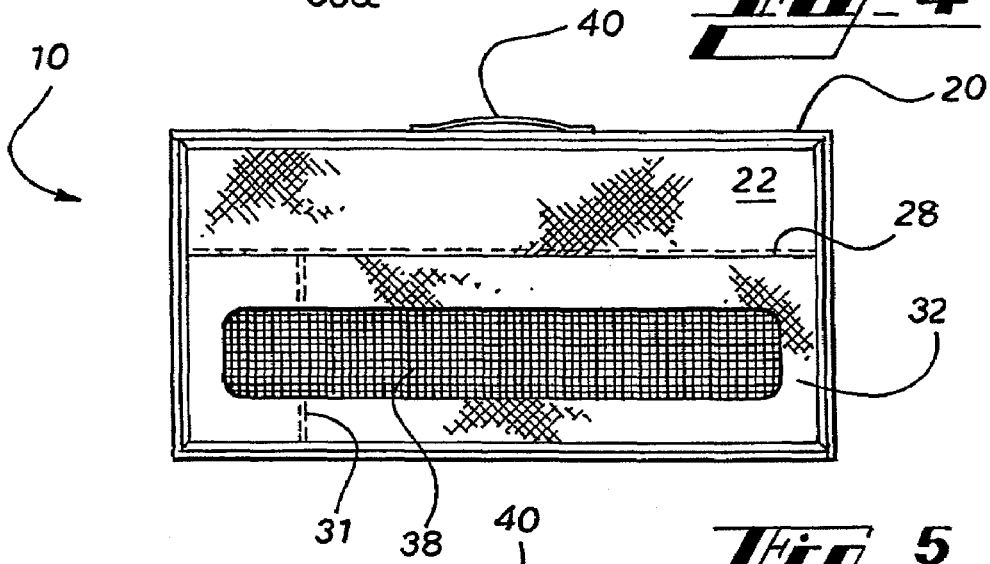
FIG. 5 is a rear elevational view of the briefcase of the present invention illustrated in FIG. 1.
Figure 6:
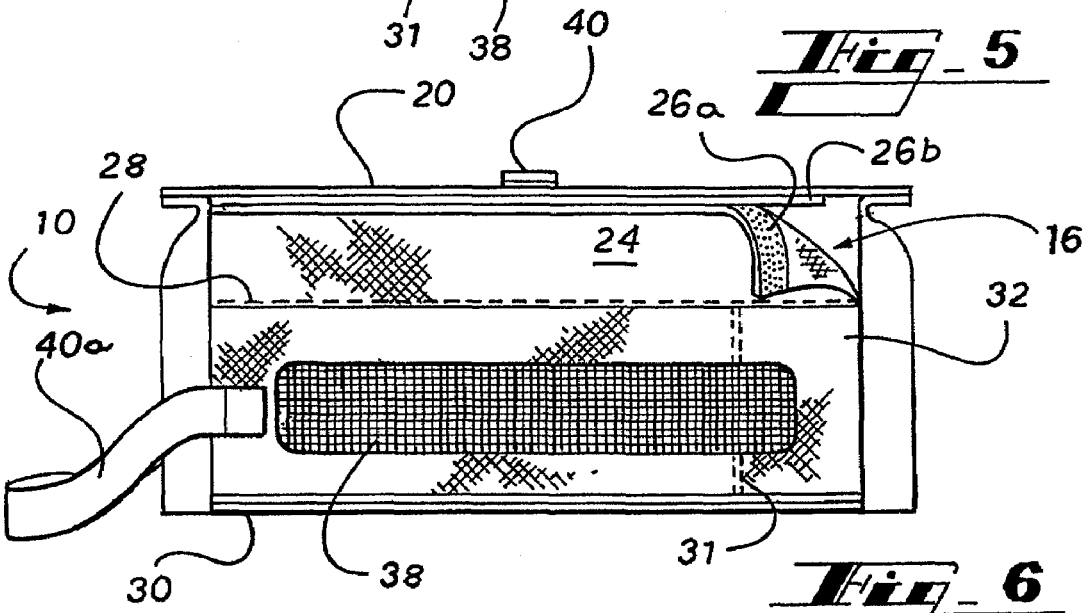
FIG. 6 is a right side elevational view of the briefcase of the present invention illustrated in FIG. 1.
Figure 7A:
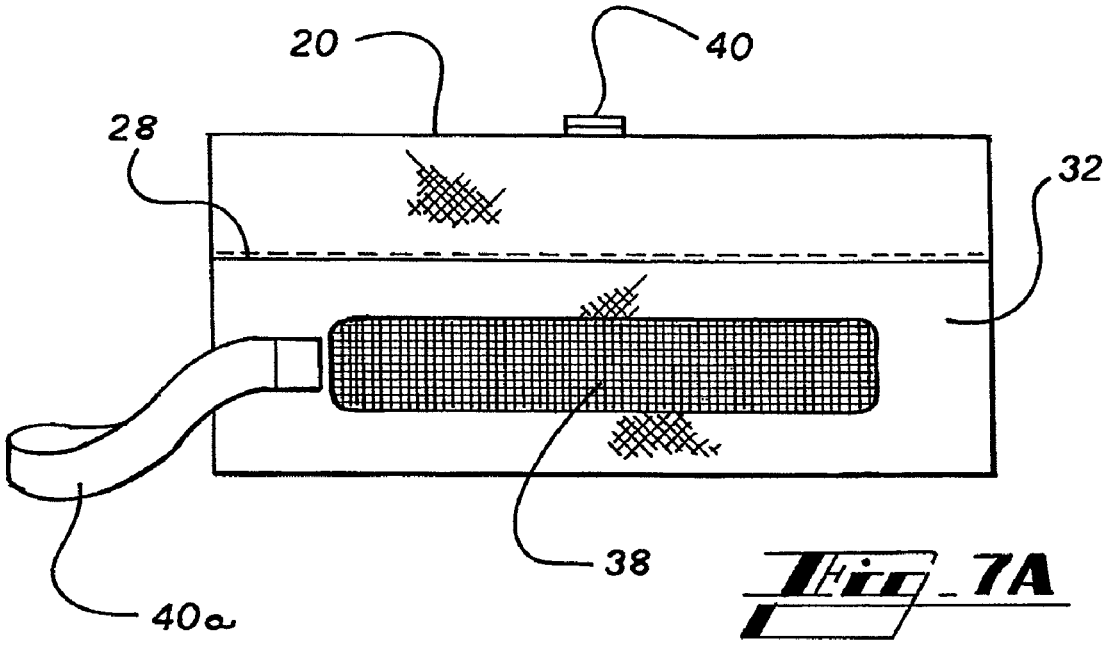
FIG. 7*a* is a left side elevational view of the briefcase of the present invention illustrated in FIG. 1.
Figure 7B:
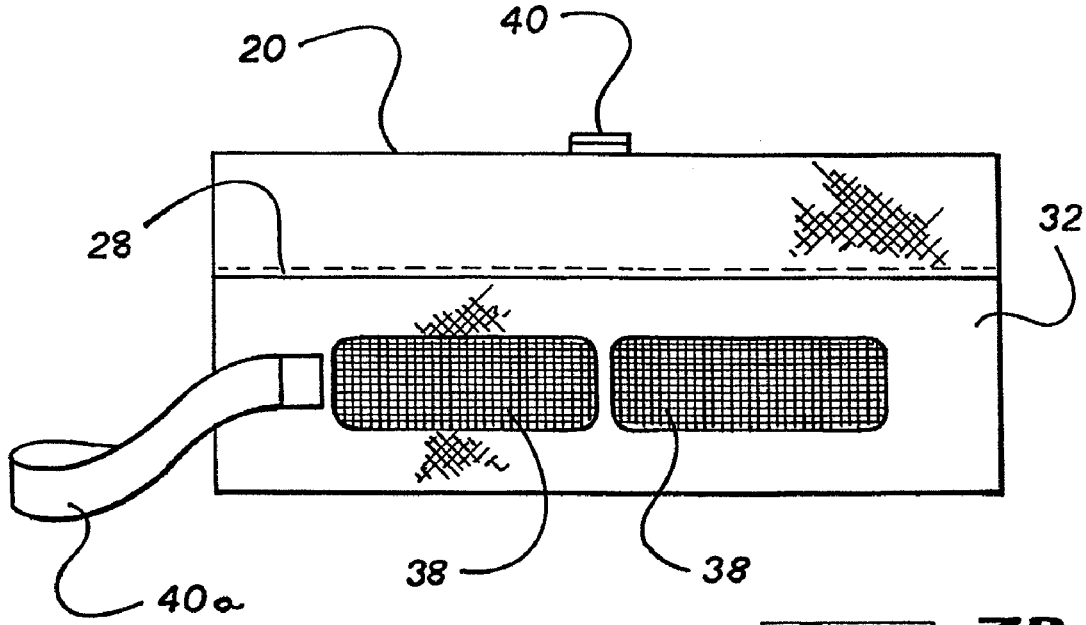
FIG. 7*b* is a second embodiment of the left side elevational view of the briefcase of the present invention illustrated in FIG. 1.
Figure 8:
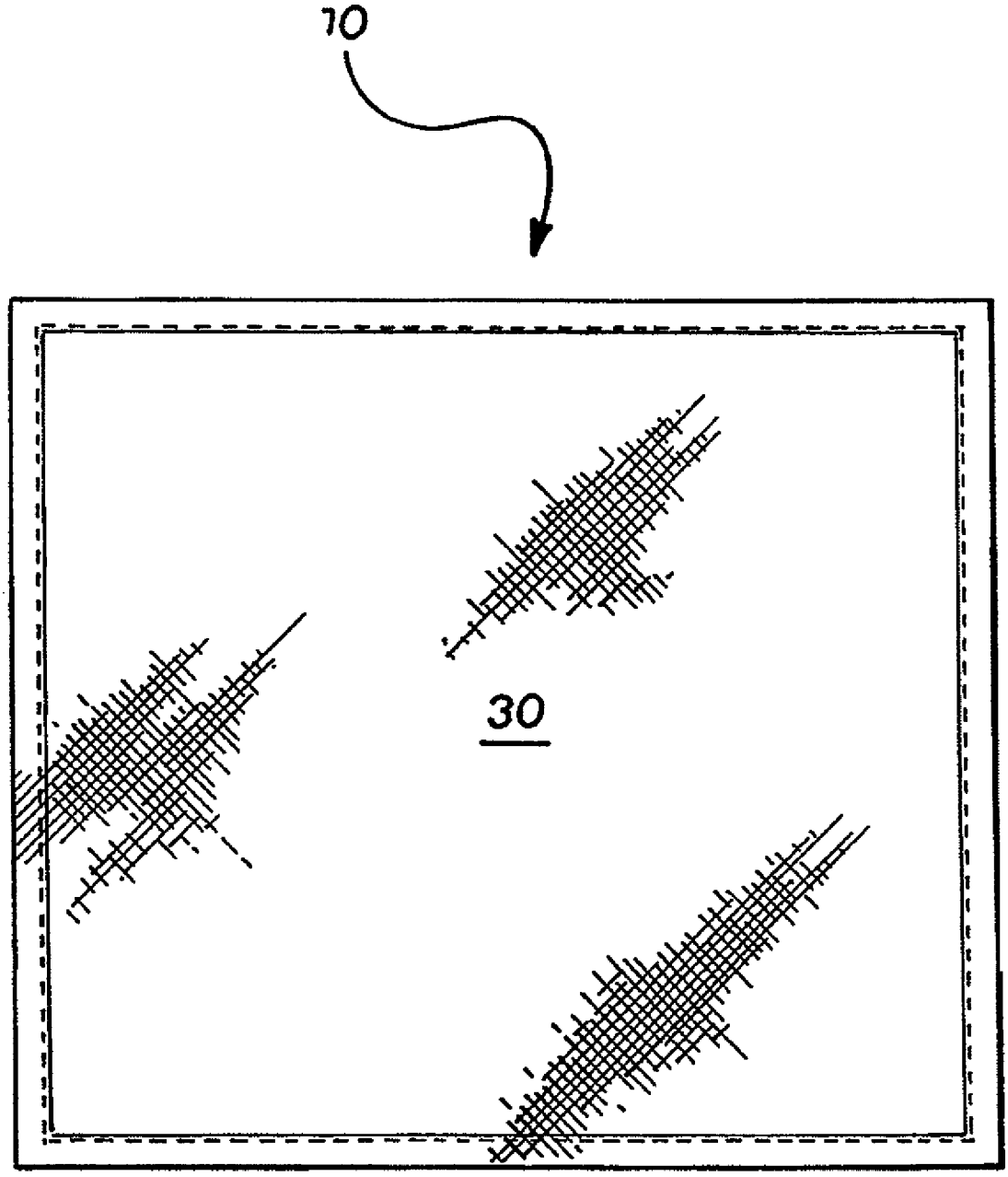
FIG. 8 is a bottom view of the briefcase of the present invention illustrated in FIG. 1.

Continuing to view FIGS. 3, 5, and 6, the second section 14 is defined by a second outer surface or bottom wall 30 and side surfaces 32 that are positioned between the second outer surface 30 and the center partition 28, with these elements defining a second opening 18 to receive the projector 6. A second securing or closure member 34 is connected to the central partition 28. In the embodiment illustrated in FIGS. 3 and 4, a second connecting element 36*a*, such as a hook and loop material, button, zipper, or other similar fastener, is attached proximate one end of the closure member 34, with a corresponding first connecting element 36*b* being affixed proximate one edge of the second outer surface 30. As a result, once the user has inserted the projector 6 into the second section 14 (in direction B), the first connecting element 36*a* attached to the closure member 34 can be connected with the second connecting member 36*b* to secure the projector 6 within the first section 12.

Figure 2:
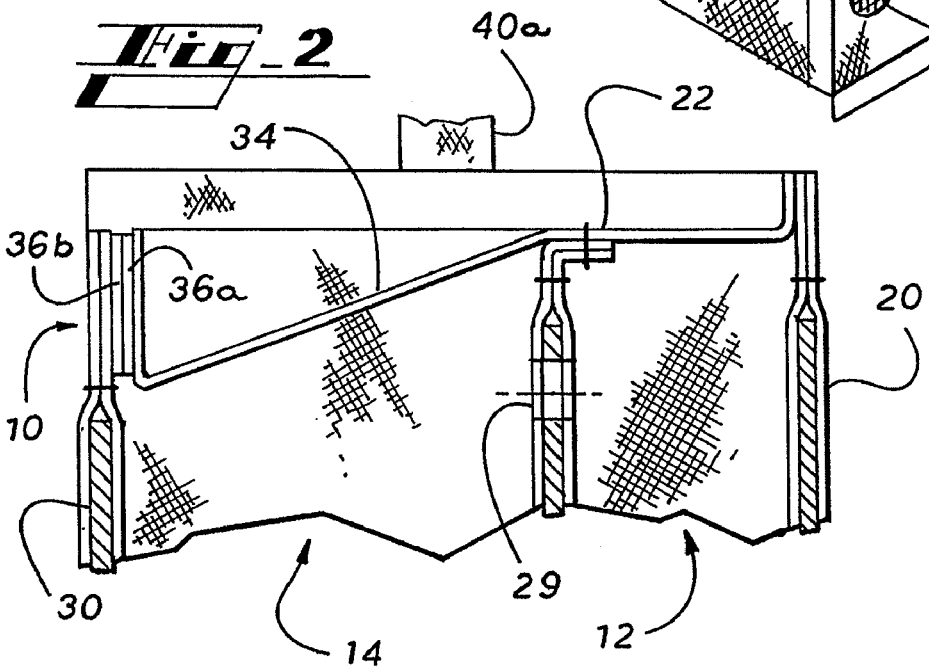
FIG. 2 is a sectional side view of the briefcase of the present invention taken along lines 2-2 of FIG. 1.

Referring now to FIG. 2, an aperture 29 is illustrated traversing the intermediate partition 28. The aperture 29 is positioned within the intermediate partition 28 of the briefcase 10 so as to allow connectors to join the computer 8 with the projector 6 inside the briefcase 10, which allows for completed connections at the time that the projector 6 and computer 8 are stored in the briefcase 10. This allows the user to avoid the problem traditionally encountered with the use of the combination of such devices, in that the once the user arrives at the location for the presentation, the components must then be connected and tested for interoperability. With the present briefcase 10, the components are already connected when stored in the briefcase 10, and simply need to be connected to a power source to begin use of the components for the presentation.

Referring to FIGS. 5 and 6, the briefcase 10 is illustrated as having an additionally secondary wall or partition 31 that defines a storage compartment in the briefcase for auxiliary components necessary to operate the projector 6 or computer 8. For example, the compartment defined by the secondary partition 31 may be used to store power cables or the cables for connecting the computer 8 to a network of other computers.

Looking to FIGS. 5 through 7*b*, a series of vented windows 38 are integrated into one or more of the side surfaces 32 to allow the heat from the projector 8 to be dissipated from within the briefcase 10. In the views shown in FIGS. 5, 6, and 7*a*, a single vented window 38 is shown. However, in the embodiment shown in FIG. 7*b*, more than one vented window 38 can be incorporated. The use of multiple vented windows 38 in one surface 32 allows the user to add additional partition walls 31 inside the briefcase 10 without the partitions engaging the vented windows 38.

The first and second outer surfaces 20, 30 are preferably made of a substantially rigid material to protect the projector 6 and the computer 8 from exterior forces. Furthermore, the center partition 28 is also made of a substantially rigid material. The substantially rigid material for the first and second outer surfaces 20, 30 and the intermediate partition 28 used in the present invention could be a sheet of a wood based material or a metal having the desired unyielding properties. The rigid the outer surfaces 20, 30 and center partition 28 maintain the definition of the first and second sections 12, 14 respectively. In addition, the rigid surfaces provide an even support for both the projector 6 and the computer 8. More specifically, when the projector 6 and the computer 8 are to be used, the second outer surface 30 will be placed on the base surface, such that the projector 6 will rest on a flat and stiff surface. Furthermore, the center partition 28 will additionally rest on the housing of the projector 6, such that the computer 8 will also rest on a flat and stiff surface.

The briefcase 10 may additionally include a support member, such as a handle 40, that is attached to the first outer surface 20. The handle 40 is securely affixed to the briefcase 10, such that the user will be able to easily move and position the briefcase 10 even when both a computer 8 and projector 6 are stored within the briefcase 10. In addition to the handle 40, the briefcase 10 may include carrying member, such as an arm strap 42, attached to the side surfaces 32 of the second section 14. The arm strap 42 is attached to briefcase 10 in such a way that the user is able to easily tote the briefcase 10 over the user's shoulder and yet not apply too much pressure to either first or second closure member 24, 34.

It is to be noted that the first opening 16 and the second opening 18 of the illustrated embodiment are orthogonal to each other. Because the openings are positioned a right angles, the computer 8 is inserted into the briefcase 10 in a direction A that is normal to the direction of insertion of the projector 6 (direction B). As a result, when the projector 6 is facing the screen on which the image is being projected, the computer 8 will be accessible on the side of the projector 6 from the first opening 16. However, it should also be noted that the openings may be reversed or parallel to each other as desired by the user.

Having thus described exemplary embodiments of the present invention, it should be noted by those skilled in the art that the within disclosures are exemplary only and that various other alternatives, adaptations, and modifications may be made within the scope of the present invention. Accordingly, the present invention is not limited to the specific embodiments as illustrated herein, but is only limited by the following claims.

What is claimed is:

1. A briefcase for jointly storing and transporting a projector and a computer in operating condition, said briefcase comprising:

a first section having a first opening to receive the computer;

means for securing the computer in said first section;

a second section having a second opening to receive the projector, said second opening orthogonal to said first opening; and means for securing the projector in said second section; and a substantially rigid intermediate layer separating said first section from said second section.

2. The briefcase as described in claim 1, wherein said second section comprises at least one vented window.

3. The briefcase as described in claim 1, further comprising:

a strap connected to said briefcase.

4. The briefcase as described in claim 1, further comprising:

an aperture traversing said intermediate layer, said aperture allowing the projector to be in electrical communication with the computer.

5. The briefcase as described in claim 1, comprising:

a substantially rigid top wall of said first section;

a substantially rigid bottom wall of said second section;

a substantially flexible rear wall connected between said top wall and said bottom wall.

6. The briefcase as described in claim 5, wherein said means for securing the computer in said first section comprises:

a first flap connected to said intermediate section; and means for connecting said first flap with said top wall.

7. The briefcase as described in claim 6, wherein said means for securing the projector in said second section comprises:

a second flap connected to said intermediate section; and means for connecting said second flap with said bottom wall.

8. The briefcase as described in claim 7, wherein said means for connecting said first flap with said top wall comprises a hook and loop material affixed to said first flap and to said top wall; and wherein said means for connecting said second flap with said bottom wall comprises a hook and loop material affixed to said second flap and to said bottom wall.

9. The briefcase as described in claim 5, further comprising a secondary partition connected between said intermediate layer and said bottom wall to define a storage compartment.

10. The briefcase as described in claim 1, wherein said first section further includes a partition wall connected between said intermediate wall and said bottom wall, said partition wall defining a storage section of the briefcase.

11. A container for storing and transporting a projector and a computer in operating condition, said container comprising:

a housing having a substantially rigid top wall;

a substantially rigid bottom wall; and a flexible side wall connecting said top wall with said bottom wall;

a substantially rigid intermediate partition affixed within said housing to said flexible side wall, said intermediate partition separating said housing into a first chamber to store the computer and a second chamber to store the projector;

an aperture traversing said partition to connect the computer with the projector;

means for securing the computer in said first section; and means for securing the projector in said second section.

* * * * *